US008265539B2

(12) United States Patent
Zweedijk et al.

(10) Patent No.: US 8,265,539 B2
(45) Date of Patent: Sep. 11, 2012

(54) METHOD OF CLEANING A TONER IMAGE CARRIER

(75) Inventors: Johan J. Zweedijk, Venlo (NL); Stanislaw K. J. Lenczowski, Waalre (NL); Jacobus H. Vercoulen, Velden (NL)

(73) Assignee: Oce-Technologies B.V., Venlo (NL)

( * ) Notice: Subject to any disclaimer, the term of this patent is extended or adjusted under 35 U.S.C. 154(b) by 335 days.

(21) Appl. No.: 12/465,813

(22) Filed: May 14, 2009

(65) Prior Publication Data

US 2009/0285598 A1 Nov. 19, 2009

(30) Foreign Application Priority Data

May 15, 2008 (EP) ..... 08156248

(51) Int. Cl.
*G03G 21/00* (2006.01)

(52) U.S. Cl. ..... 399/343; 399/357; 399/358; 399/297; 399/71

(58) Field of Classification Search ..... 399/343, 399/357, 308, 17, 149, 297, 302, 71, 123, 399/127

See application file for complete search history.

(56) References Cited

U.S. PATENT DOCUMENTS

2005/0069355 A1 * 3/2005 Watanabe et al. ..... 399/343
2007/0292178 A1 12/2007 Iwasaki et al.

FOREIGN PATENT DOCUMENTS

EP 1 632 821 A1 3/2006
WO WO 89/06384 * 7/1989
WO WO-98/25188 A1 6/1998

* cited by examiner

*Primary Examiner* — David Porta
*Assistant Examiner* — Yara Green
(74) *Attorney, Agent, or Firm* — Birch, Stewart, Kolasch & Birch, LLP

(57) ABSTRACT

A method and apparatus for cleaning an image carrier that is used for transferring a toner image onto a recording medium which includes a black image step in which a black image, i.e., an image of the entire area which is filled with toner, is formed on the image carrier and is transferred onto a cleaner that engages the image carrier for removing dust therefrom, wherein, prior to the black image step, a black page step is carried out in which a black page is printed by transferring a black image from the image carrier onto the recording medium.

4 Claims, 3 Drawing Sheets

METHOD OF CLEANING A TONER IMAGE CARRIER

This non-provisional application claims priority under 35 U.S.C. §119(a) on European Patent Application No. 08156248.0 filed in the European Patent Office on May 15, 2008, which is herein incorporated by reference.

BACKGROUND OF THE INVENTION

The present invention relates to a method and apparatus for cleaning an image carrier that is used for transferring a toner image onto a recording medium, wherein a black image, i.e., an image, the entire area of which is filled with toner, is formed on the image carrier and is transferred onto a cleaner that engages the image carrier for removing dust therefrom.

The invention is applicable, for example, to electrographic or magnetographic copiers and printers, and, more generally, to all kinds of image forming apparatus in which a toner image is transferred from an image carrier onto a recording medium.

It is a general problem with such image forming apparatus that certain types of recording media, especially certain types of paper, such as offset paper, home-cut paper that has been cut into sheets in a special apparatus on the premises of the user, and the like, tend to release a considerable amount of dust inside the apparatus. The dust is deposited on sensitive component parts of the apparatus and disturbs the image forming process. Among other contaminates, dust is deposited on the image carrier, so that the image carrier has to be cleaned from time to time.

U.S. Pat. No. 5,227,844 discloses a cleaning process in which a specific cleaning sheet is fed through the apparatus in place of the regular recording medium in order to collect and remove the dust.

A cleaning process as defined above has been employed by the applicant. In this process, a cleaner, typically in the form of a drum, e.g., a so-called spiral cleaner, is arranged at the periphery of the drum-type or belt-type image carrier, so as to remove the dust from the surface of the image carrier and to collect the dust on the cleaner. However, with an increasing amount of dust being deposited on the cleaner, the cleaning capacity degrades, so that the dust can no longer be removed completely from the image carrier. For this reason, the cleaner has to be regenerated from time to time. This is achieved by means of a so-called black image process in which a black image is formed on the image carrier and is then transferred onto the cleaner. As a consequence, the dust that has been deposited on the cleaner is buried in a layer of toner, and this restores the capacity of the cleaner to collect more dust. The term "black image" is used for simplicity and is to indicate that the entire surface of the image carrier that is normally used for carrying an image is covered with a continuous layer of toner, but it will be understood that the actual color of the toner (normally black) is not important.

SUMMARY OF THE INVENTION

It is an object of the present invention to provide a method for improving the quality of printed images.

In order to achieve this object, the invention is characterized in that, prior to the black image step, a black page step is carried out in which a black page is printed by transferring a black image from the image carrier onto the recording medium.

It has been found that the quality of the printed images may sometimes be degraded, at least for the first few images that are printed after the conventional black image cleaning process has been carried out. This effect has been traced back to the following mechanism. When the black image process is carried out at a time when a curtain amount of dust has remained on the surface of the image carrier, this dust tends to retain the toner on the surface of the image carrier, so that, in the black image process, the toner layer is not entirely transferred onto the cleaner as desired, but certain residues of toner remain on the surface of the image carrier. Then, when the next images are printed onto the recording medium, the toner residues on the image carrier result in the dark or "dirty" background on the sheets of the recording medium. Of course, the amount of dust that remains on the surface of the image carrier and causes this effect will be particularly large when the cleaning capacity of the cleaner has decreased after a long time of use and, accordingly, it is time to perform the next cleaning cycle.

According to the present invention, at least one black page step precedes the black image cleaning step. In the black page step, the surface of the image carrier is covered with a continuous layer of toner, as in the black image step, but this toner layer is not transferred onto the cleaner but onto the recording medium, so that a black page is printed which will then have to be discarded. The advantage is that, in this transfer process, not only the toner layer but also the dust that had been deposited on the image carrier is transferred onto the recording medium, so that the dust is removed from the image carrier very efficiently. In this way, the image carrier is prepared for the subsequent black image process. Then, the toner layer is applied onto a practically clean surface of the image carrier and, consequently, is transferred completely onto the cleaner, without leaving on the image carrier any toner residues that would impair the quality of the images subsequently printed.

In this way, a quality of the printed images, especially of those images that are printed immediately after a cleaning process, can be improved significantly, even in a situation in which a relatively large amount of dust had accumulated on the image carrier. Consequently, the present invention also permits, for a given quality of the recording media, a reduction in the frequency at which the cleaning processes have to be performed. Conversely, for a given frequency of the cleaning processes, the present invention permits the accommodation of "critical" recording media which tend to release large amounts of dust.

BRIEF DESCRIPTION OF THE DRAWINGS

Preferred embodiments of the present invention will now be described in conjunction with the drawings, wherein.

DETAILED DESCRIPTION OF THE INVENTION

Figure 1:
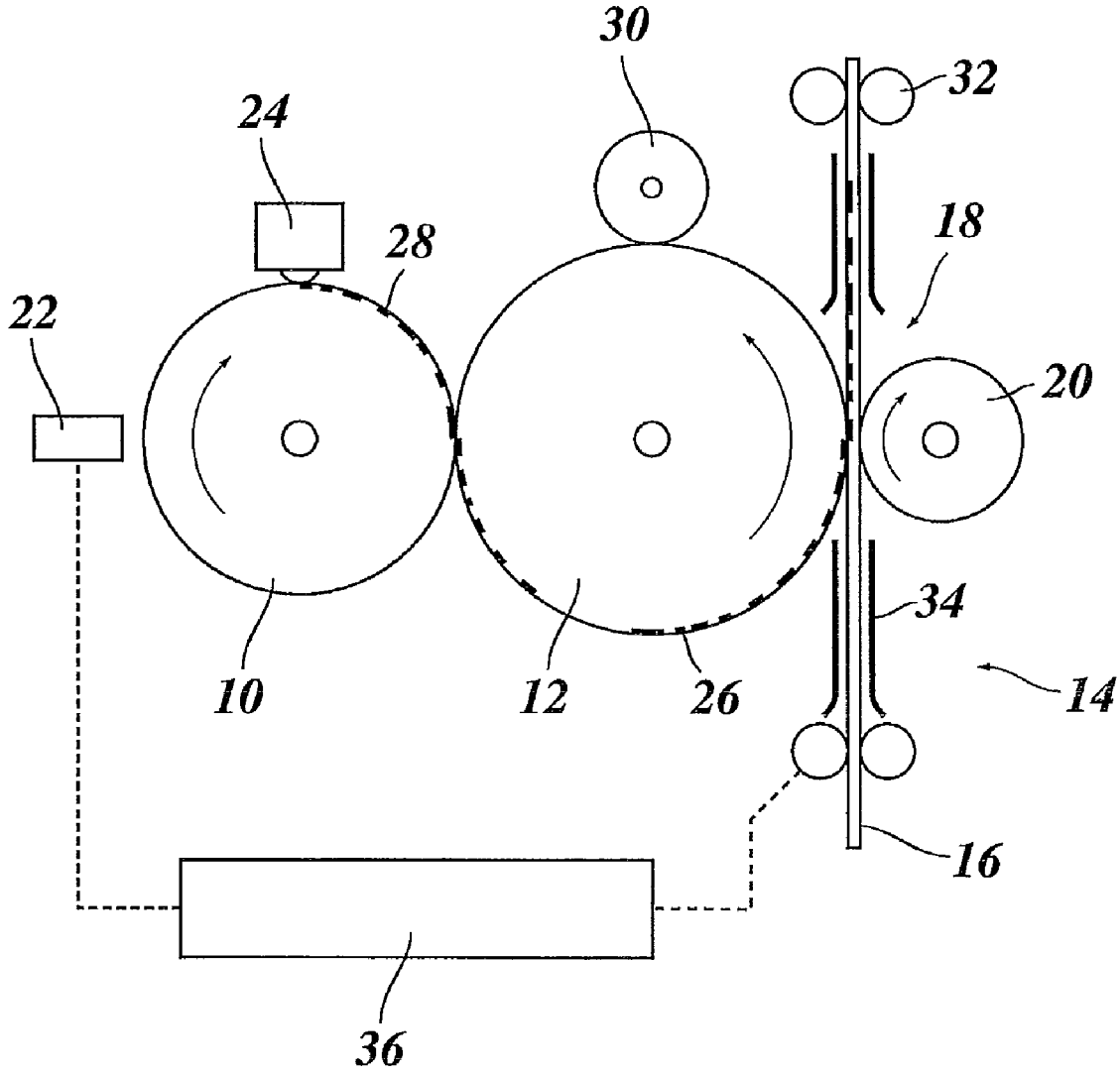
FIG. 1 is a schematic view of an image forming apparatus to which the invention is applicable.

FIG. 1 shows an example of an image forming apparatus having a photoconductive drum 10, a drum-type image carrier 12 and a transport system 14 arranged for feeding sheets 16 of a recording medium, e.g., paper, through a transfuse nip 18 formed between the image carrier 12 and a heated fuse roller 20.

An image forming system 22 is arranged at the periphery of the photoconductive drum 10 for creating an electrostatic charge image on the surface of the drum. By way of example, the image forming system 22 may comprise a laser exposure system for exposing and discharging the drum in accordance with image information supplied thereto.

A developer station 24 is arranged for developing the electrostatic charge image with (black) toner, thereby to form a toner image on the surface of the electrographic drum 10. At a nip formed between the drum 10 and the image carrier 12, the toner image is transferred onto the surface of the image carrier 12 by means of adhesion and/or electrostatic forces in a cold process. When the toner image thus formed on the surface of the image carrier 12 reaches the transfuse nip 18, it is transferred in a hot process onto the sheet 16 and is fused thereon by the heat generated by the fuse roller 20.

As has symbolically been shown in FIG. 1, a first toner image 26 is just being transferred onto the sheet 16 while a second toner image 28 is just being formed at the developer station 24 and transferred onto the image carrier 12.

A spiral cleaner 30 is arranged at the periphery of the image carrier 12 at a position downstream of the transfuse nip 18 and has the purpose to remove from the surface of the image carrier any dust that may have been released by the sheets 16.

The transport system 14 comprises several pairs of transport rollers 32 and guide plates 34 defining a transport path for the sheets 16. Some of the transport rollers 32 are driven under the control of a control unit 36 which also controls the image forming system 22 as well as the operation of the other components of the image forming apparatus.

When the recording sheets 16 are successively passed through the apparatus and printed, they will release a certain amount of dust which will be deposited on the image carrier 12 and then collected by the spiral cleaner 30. As a consequence, after a certain time of operation, depending on the quality of the recording sheets, the amount of dust collected on the surface of the spiral cleaner 30 will have become so large that the cleaning capacity decreases, and it is necessary to restore the cleaning capacity of the spiral cleaner 30. To this end, a cleaning sequence is performed that will now be described in conjunction with FIGS. 2 and 3. This cleaning process comprises a black page process as a first step, illustrated in FIG. 2, and a black image process as a second step, illustrated in FIG. 3.

Figure 2:
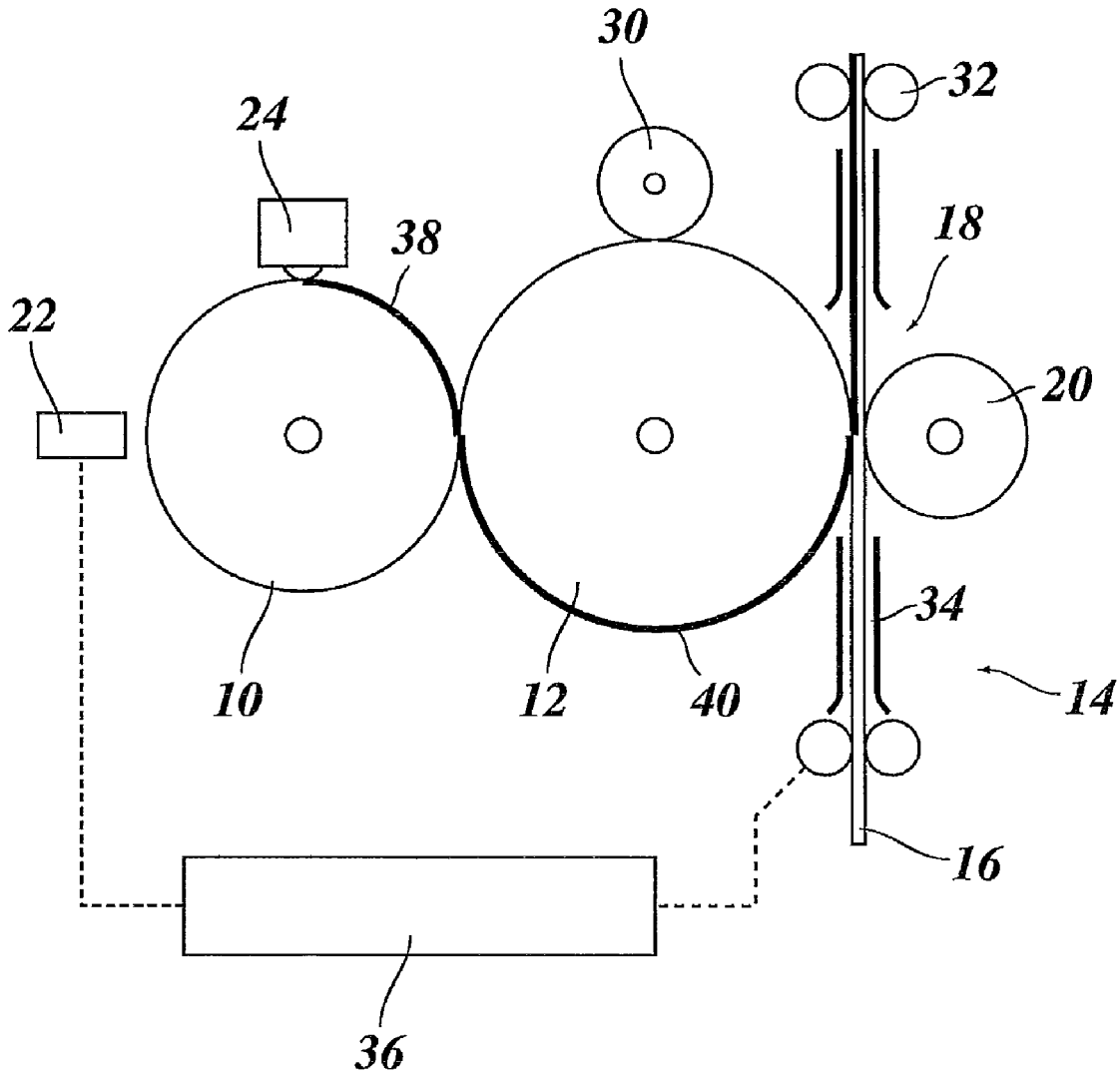
FIG. 2 illustrates a black page process.

In the black page step, shown in FIG. 2, the controller 36 activates the image forming system 22 to form an image that consists of a completely black image. When this image is developed by the developer station 24, a uniform toner layer 38 is formed on the surface of the photoconductive drum 10, and the toner is transferred onto the image carrier 12, so that a uniform toner layer 40 is also formed on the image carrier 12 in the circumferential area between the nip with the drum 10 and the transfuse nip 18. In the transfuse nip, the toner is transferred in a hot process onto a sheet 16 that has been supplied by the transport system 14, so that the sheet will leave the apparatus as a black page.

The toner layer 40 on the image carrier 12 accommodates any dust particles that may be present on the surface of the image carrier, and when the toner layer 40 is transferred onto the sheet 16, the dust particles are transferred onto the sheet together with the toner and are thus removed from the apparatus.

If necessary, several black pages may be printed in this way, until essentially all dust has been removed from the surface of the image carrier 12.

In the example shown, the recording medium consists of several cut sheets 16 which are fed through the apparatus one after the other, with slight gaps therebetween, and in a normal printing process, the images formed by the image forming system 22 will only have a length corresponding to that of the sheets 16. However, if several black pages are printed in the black page process, the image forming system 22 may be activated continuously, so that the toner layers 38 and 40 are not interrupted by any gaps.

Figure 3:
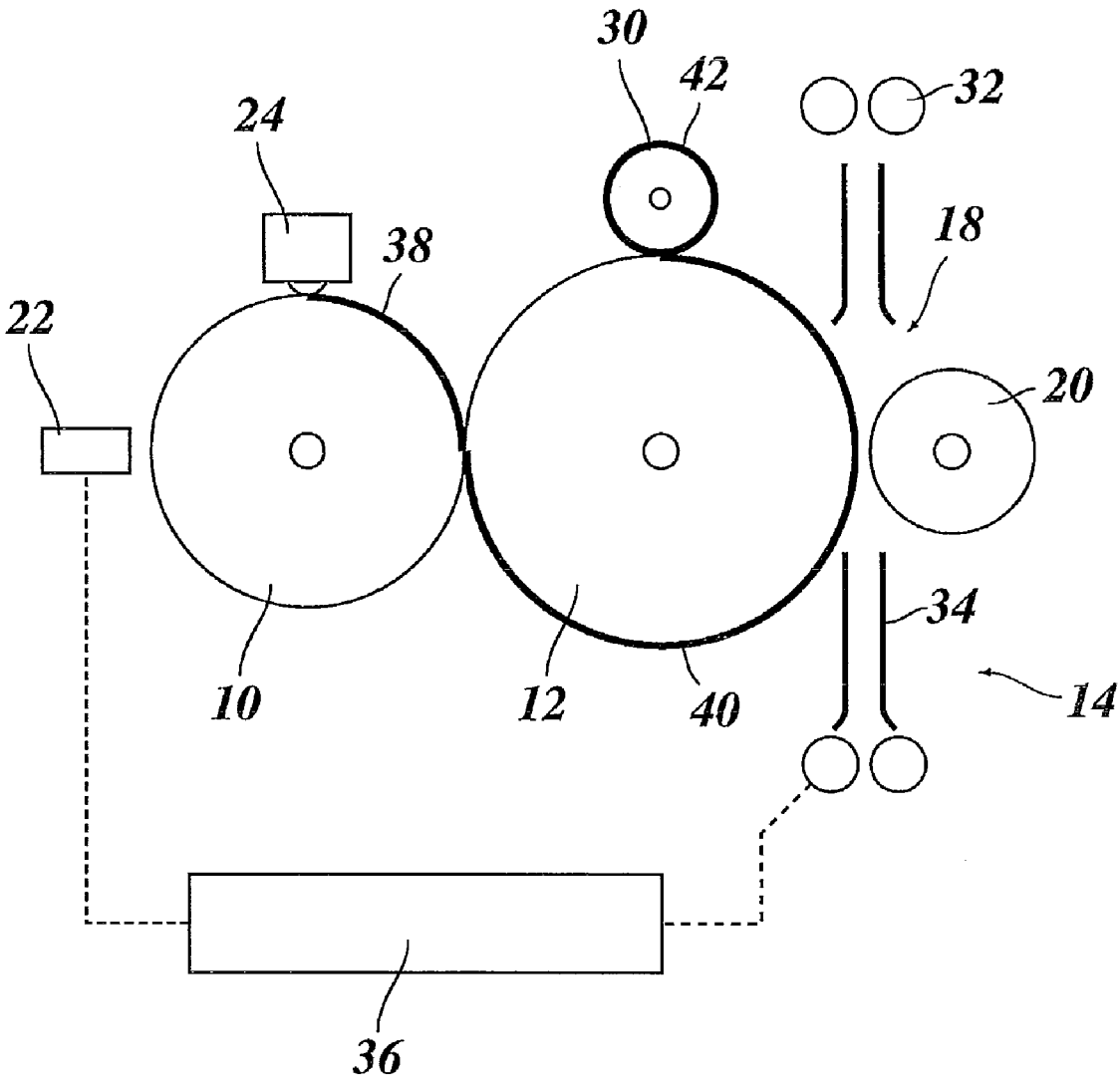
FIG. 3 illustrates a black image process.

When the surface of the image carrier 12 has become sufficiently clean, a black image process will be performed, as is illustrated in FIG. 3.

Just as in the black page process, continuous toner layers 38 and 40 are formed on the surface of the drum 10 and on the image carrier 12. In this case, however, the transport system 14 is controlled to suspend the supply of recording medium sheets for a certain time, so that the transport path is empty. As a result, the toner layer 40 is not transferred onto any recording medium, but is passed on until it reaches the nip formed between the image carrier 12 and the spiral cleaner 30. If necessary, the fuse roller 20 may be somewhat retracted from the image carrier in order to prevent toner from being transferred onto the fuse roller.

The toner that reaches the spiral cleaner 30 is transferred from the image carrier 12 onto the cleaner and forms a toner layer 42 on the surface of the cleaner.

As a consequence of the preceding black page step, the surface of the image carrier 12, when receiving the toner layer 40, was free of any dust particles which would have had a tendency to retain the toner on the image carrier. Thus, the toner is readily released from the image carrier 12 and transferred onto the cleaner 30 without leaving any toner residues on the image carrier 12.

The black image process may be continued or repeated until the toner layer 42 on the cleaner 30 has reached a sufficient thickness. Then, when new sheets are printed in the same way as in FIG. 1, the surface of the image carrier 12 will not only be free of dust but also free of any toner residues, so that an excellent print quality can be achieved. As is known in the art, the toner layer 42 will remain on the cleaner 30 and will bury the dust that has been accumulated thereon, thereby restoring the cleaning capacity of the cleaner, so that new sheets may be printed in excellent quality, until the next cleaning process becomes necessary.

The cleaning process that has been described above is applicable also in an apparatus in which images are not printed on separate sheets but on a recording medium in the form of a continues web. Then, of course, care must be taken that no toner is transferred onto the fuse roller 20, the clean image step shown in FIG. 3.

If the image forming apparatus is capable of printing on sheets or webs that may have different widths, it will be understood that both, the black image process and the black page process should be performed for the maximum width of the recording medium, so that dust will be removed from the image carrier 12 on the entire (axial) length thereof and the toner layer 42 will be applied on the entire length of the cleaner 30. In the black page step, sheets or a web with a maximum width should be fed through the transfuse nip 18. When printing on a continuous web, a known web change mechanism may be used for automatically selecting the web with the largest width.

In the example that has been described here, the image forming system comprises the image forming system 22 and the developer station 24. In a modified embodiment, the direct induction process (DIP), for example, might be employed for forming the toner image directly on the surface of the drum 10 which will then be a DIP drum.

Moreover, the invention is not limited to a two-step image transfer process, in which the toner image is first transferred from the drum 10 to the image carrier 12 (serving as an intermediate carrier) and then onto the recording medium. In a modified embodiment, the toner image could be formed directly on the surface of the image carrier 12.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A method of cleaning an image carrier that is used for transferring a toner image onto a recording medium, the method comprising:

performing a black image step by forming a black image in which an entire area which is filled with toner, is formed on the image carrier and transferred onto a cleaner that engages the image carrier for removing dust therefrom; and performing a black page step prior to the black image step, said black page step being carried out by printing a black page in which the black page is printed by transferring a black image from the image carrier onto the recording medium.

2. The method according to claim 1, wherein the images, including the black images, are first formed on an image forming drum and are then transferred onto the image carrier.

3. The method according to claim 2, wherein the step of transferring the image from the image forming drum onto the image carrier is a cold process and the step of transferring the image from the image carrier to the recording medium is a hot process.

4. An image forming apparatus comprising an image carrier, a transport system for introducing a recording medium to the transfer station for transferring a toner image from the image carrier onto the recording medium, a cleaner configured to engage the image carrier at a position downstream of the transfer station, and a controller controlling the image forming process and the operation of the transport system and the transfer station whereby the controller is configured such that prior to the forming of a black image step in which an image which is formed on the image carrier is transferred to a cleaner, a black page is formed on which a black page is printed by transferring a black image from the image carrier onto the recording medium.

* * * * *